United States Patent [19]

Kathari

[11] Patent Number: 4,619,375

[45] Date of Patent: Oct. 28, 1986

[54] SHEET DISPENSER

[76] Inventor: Franz Kathari, 5, chemin des Coquelicots, 1214 Vernier, Switzerland

[21] Appl. No.: 704,529

[22] Filed: Feb. 22, 1985

[30] Foreign Application Priority Data

Feb. 22, 1984 [CH] Switzerland ..... 852/84

[51] Int. Cl.[4] ..... A24F 15/04; G07F 11/46

[52] U.S. Cl. ..... 221/186; 221/187; 221/199; 221/256

[58] Field of Search ..... 221/186, 187, 259, 256, 221/97, 199; 206/214, 215; 271/131, 135, 137, 141, 142, 133, 134, 136, 138, 139, 140, 143, 144; 40/508, 509, 511

[56] References Cited

U.S. PATENT DOCUMENTS 861,245 7/1907 Armstrong ..... 271/135
3,299,805 1/1967 Mulreed et al. ..... 271/136 X
4,023,705 5/1977 Reiner et al. ..... 221/186
4,405,124 9/1983 Watanabe ..... 271/135

FOREIGN PATENT DOCUMENTS 476306 8/1951 Canada ..... 271/44
2144084 9/1971 Fed. Rep. of Germany ..... 271/131

*Primary Examiner*—Joseph J. Rolla
*Assistant Examiner*—P. McCoy Smith
*Attorney, Agent, or Firm*—Anthony A. O'Brien

[57] ABSTRACT

The distributor comprises a carriage (2) intended to contain a stack of sheets. This carriage (2) is mounted to slide between two stop positions on a support plate (7) thanks to ball bearings (6). The support plate (7) exhibits a slightly elevated rear portion (9) with a front step part (9*a*). By making a back and forth movement with the carriage (2), the bottom sheet of the stack is separated from the stack and held by the step (9*a*) on the front part of the plate (7) making it easy to take notes with but a single hand.

3 Claims, 3 Drawing Figures

SHEET DISPENSER

This invention relates to a sheet dispenser intended to dispense the bottom sheet of a stack of sheets.

Sheet dispensers are known that generally comprise a box open in its upper part by which a sheet can be taken. Some of these dispensers are equipped with an elastic element placed at the bottom of the box and pulling the sheets upward against holding elements. Such a dispenser is described in Swiss Pat. No. 593,830. These dispensers have the drawback that it is very inconvenient to write on the upper sheet since the hand is generally not supported.

There are also automatic sheet dispensers for printers or other printing machines, in which the bottom sheet of a stack of sheets is separated from the rest of the stack by suction as a result of suction elements (see Swiss Pat. No. 596,651). This sheet is then picked up by a transport mechanism to bring it into printing position. These dispensers, however, exhibit a costly and complicated design and therefore cannot be used for dispensing sheets for domestic use, such as telephone sheets.

It is the aim of this invention to create an inexpensive sheet dispenser of simple design that makes it easy to take notes. The dispenser comprises, for this purpose, a carriage mounted to slide on a support, this carriage comprising vertical walls made to contain the stack of sheets whose bottom sheet is in contact with the support, the dispenser comprising guide means intended to guide the movement of the carriage on the support from a first stop position to a second stop position, the support comprising a holding element intended to hold the bottom sheet in this second position to separate, by offsetting, the stack of sheets from the bottom sheet when the carriage is moved from said second position to the first position.

Thanks to a back and forth movement of the carriage, the bottom sheet of the stack is therefore easily separated by an uncomplicated mechanism. Since the separated sheet is in contact with the support, taking notes is easy.

The invention is described in more detail below with drawings showing an embodiment diagrammatically and by way of example.

Figure 1:
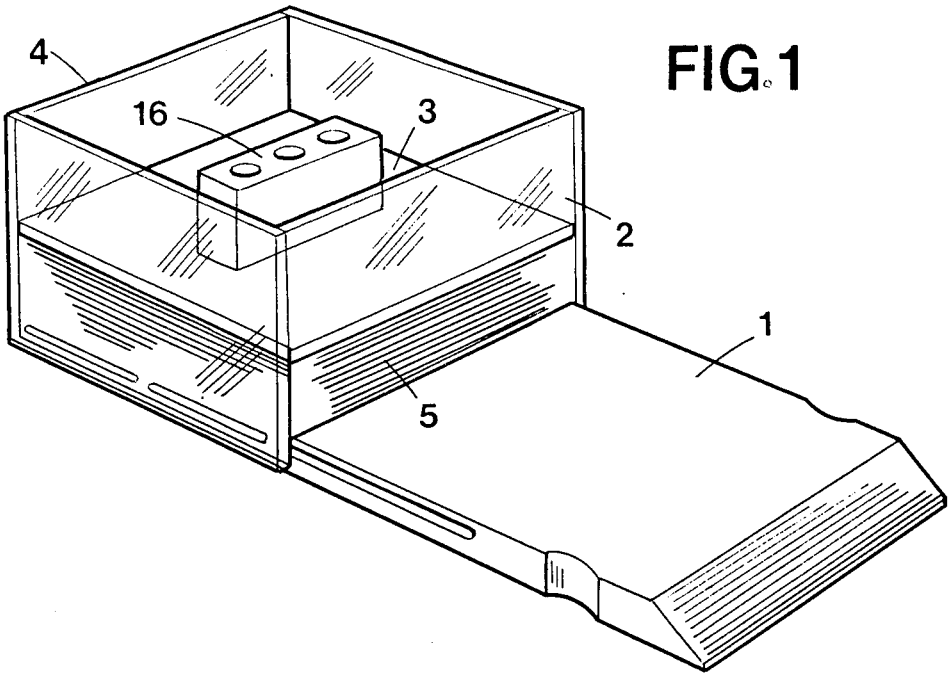
FIG. 1 is a representation in perspective of the dispenser.
Figure 2:
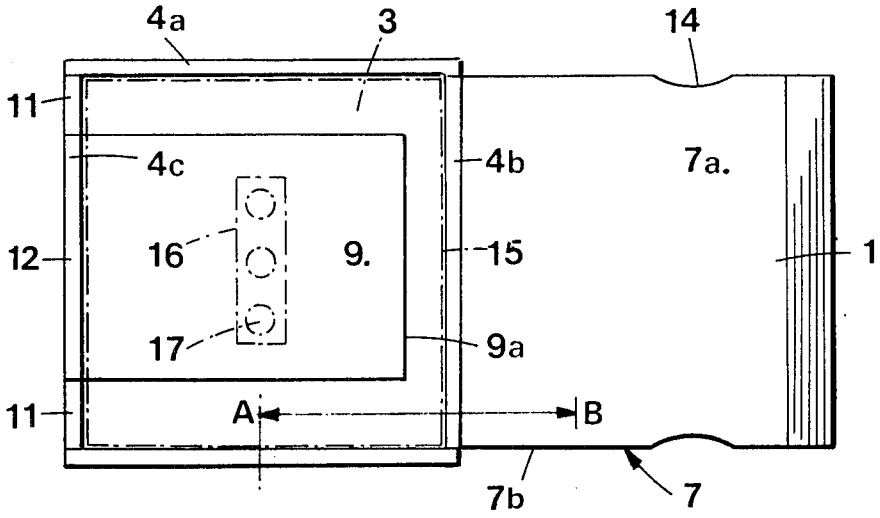
FIG. 2 is a top plan view.

The distributor consists of a support 1, a carriage 2 and a cover 3. Carriage 2 comprises four vertical walls 4 made to surround a stack of sheets 5 of paper. This carriage 2 is mounted to slide on support 1 thanks to ball bearings 6 and does not have a bottom so that sheets 5 rest directly on the upper face of support 1.

This support consists of a plate 7 that exhibits two parallel lateral faces **7*b*, each provided with a groove 6*a* for a ball bearing. Lateral walls 4*a* of the carriage include extensions 4*e* located opposite the two lateral faces 7*b* of the support. Each extension 4*e* comprises two grooves 6*b* in which balls 8 are engaged, thus constituting, with grooves 6*a***, four grooved ball bearings.

Support plate 7 exhibits an upper surface **7*a* with a slightly elevated portion 9 forming on its front part a step 9*a* with a sharp angle. The height of this step 9*a* is approximately equal to the thickness of the sheets 5 used, i.e., a tenth of a millimeter. Front wall 4*b* comprises a lower edge 10 that does not touch upper surface 7*a* of the support. A gap larger than the thickness of a sheet, but narrower than that of two sheets separates this edge 10 from surface 7*a*. Back wall 4*c* has a lower edge comprising two lateral portions 11 located flush with surface 7*a* and a higher middle portion 12 surrounding or overlying elevated portion 9 of plate 7**.

Figure 3:
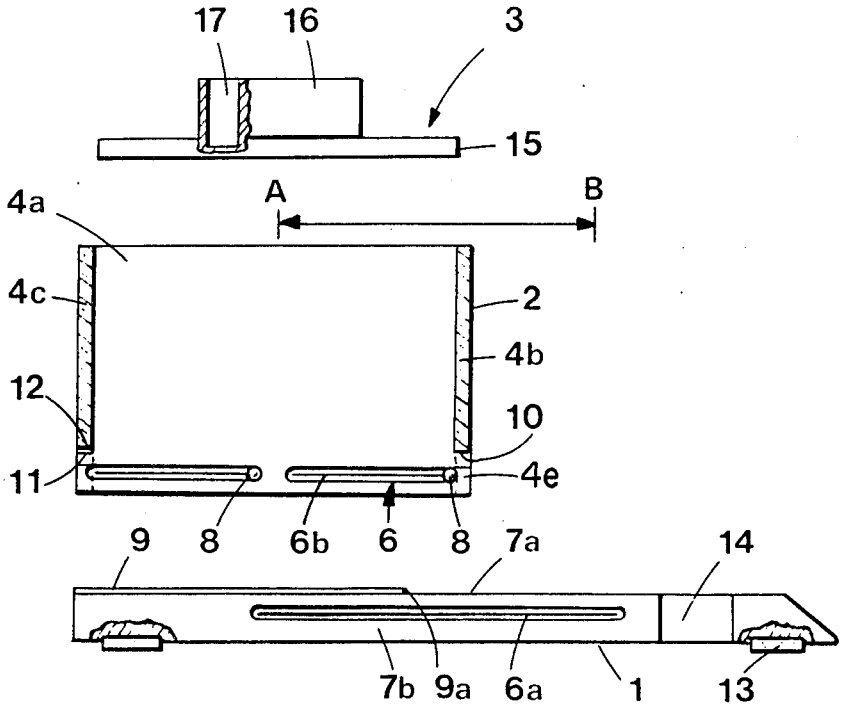
FIG. 3 shows a lateral view in partial section, the different parts of the dispenser being separated for more clarity.

Carriage 2 can be moved from a first stop position A, as shown in FIG. 3, where the sheets rest on elevated portion 9, to a second stop position B in which the bottom sheet rests entirely on surface **7*a* of the support and is applied there by the weight of the stack of sheets 5 and cover 3. When carriage 2 is pushed back from position B to position A, the bottom sheet by its edge strikes against step 9*a* and is thereby held in position B. This sheet therefore passes under lower edge 10 of front wall 4*b*** of the carriage, while the other sheets are pushed to stop position A.

The sheet which has just been separated and which rests on surface **7*a* always remains partially engaged under the stack of the sheets that are in position A so as to be held on support 7. The surface of this sheet, in position B, which is engaged under the stack, in position A, is less than a fourth of its surface. Support plate 7** thus constitutes a writing support for the sheet held in position B, which makes it easy to take notes without the sheet having to be held by the other hand of the user. The latter can thus, for example, hold a telephone receiver with one hand and take notes with the other hand.

Carriage 2 and support 1 are preferably made of plastic. Upper surface **7*a* of plate 7 advantageously exhibits a slight roughness that increases the adherence of the bottom sheet to this surface. On the other hand, the surface of elevated part 9** is completely smooth to allow easy sliding of the stack of sheets.

Nonskid elastomer linings or feet 13 are fastened to the lower face of plate 7 to prevent the latter from sliding in relation to the base on which the dispenser is placed. Lateral indentations 14 provided on the lateral edges of plate 7 make it possible to grasp easily the sheet separated from the stack.

Cover 3 has an outside shape 15 approximately identical with that of the sheets and presses the latter against the upper face of support 7. This cover 3 is advantageously equipped with a handle 16 exhibiting blind holes 17 in which pencils or pens can be inserted. This cover 3 could also carry trays for the storage of other office articles.

Of course, the embodiment described exhibits no limiting feature and it can receive any desirable modifications without thereby going outside the scope of the invention. In particular, the ball bearings could be replaced with a sliding guide. The dispenser could also be adapted for use with printers. The back and forth movement of the carriage could, at this moment, be controlled by a motor.

I claim:

1. Device for scratch pads intended to place the bottom sheet of a stack of rectangular sheets of a predetermined thickness on a writing surface for note taking comprising: a carriage mounted to slide on a support, said carriage comprising vertical walls designed to contain the stack of sheets, the device including guiding means intended to guide the movements of the carriage on the support in a feed direction from a first stop position to a second stop position, said support consisting of a plate exhibiting an upper surface comprising a plane first and second portion, the bottom sheet of said stack resting on said first portion when said carriage is in said first stop position and on said second portion when said carriage is in said second position, said first portion being located at a higher level than said second portion, a step having a height approximately equal to said predetermined thickness separating said first and second portions, said carriage having a front wall whose lower edge is separated from the surface of said second portion by a gap considerably greater than said sheet thickness but less than twice this thickness, so that the bottom sheet of said stack upon engaging said step, is separated from the stack and goes through an opening formed by this gap, when said carriage is moved from said second position to said first position, and rests on said plane second portion intended to serve as a flat writing surface, said first and second stop positions being laterally offset from one another by such a distance that a sheet disposed in said second position is partially beneath and engaged by said stack of sheets that is in said first position so that the sheet in said second position has a part of its surface pressed against the underlying support.

2. Device according to claim 1, wherein said carriage is mounted by ball bearings on said support.

3. Device according to claim 1, including a cover having a contour approximately identical with that of said sheets and intended to overlie and press said sheets against said upper surface of said support, and elements on an upper face of said cover for storage of office articles.

* * * * *